US007059889B1

(12) United States Patent
Pavlovic et al.

(10) Patent No.: US 7,059,889 B1
(45) Date of Patent: Jun. 13, 2006

(54) SPLICE BLOCK FOR INTERCONNECTING ELECTRICAL CONDUCTORS

(75) Inventors: Slobadan Pavlovic, Canton, MI (US); Mohamad Zeidan, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/248,642

(22) Filed: Oct. 12, 2005

(51) Int. Cl.
*H01R 11/20* (2006.01)

(52) U.S. Cl. ..... 439/397; 439/417

(58) Field of Classification Search ..... 439/397, 439/417, 521, 936, 402
See application file for complete search history.

(56) References Cited

U.S. PATENT DOCUMENTS

| | | | | |
|---|---|---|---|---|
| 3,869,190 | A * | 3/1975 | Bazille, Jr. | 439/400 |
| 3,877,771 | A * | 4/1975 | Jensen et al. | 29/752 |
| 4,252,397 | A | 2/1981 | Eigenbrode et al. | |
| 4,573,752 | A | 3/1986 | Rich | |
| 4,581,820 | A | 4/1986 | Zahn et al. | |
| 4,701,001 | A | 10/1987 | Verhoeven | |
| 4,773,752 | A | 9/1988 | Béchet et al. | |
| 4,954,098 | A * | 9/1990 | Hollingsworth et al. | 439/404 |
| 5,013,877 | A | 5/1991 | Jervis | |
| 5,302,137 | A * | 4/1994 | Suffi | 439/403 |
| 5,358,424 | A | 10/1994 | Bowen et al. | |
| 5,364,288 | A | 11/1994 | Drewanz et al. | |
| 5,433,626 | A | 7/1995 | Drewanz et al. | |
| 5,435,747 | A | 7/1995 | Franckx et al. | |
| 5,492,485 | A | 2/1996 | Drewanz et al. | |
| 5,498,173 | A | 3/1996 | Drewanz et al. | |
| 5,562,480 | A | 10/1996 | Drewanz et al. | |
| 5,782,652 | A * | 7/1998 | Feher et al. | 439/417 |
| 6,074,238 | A | 6/2000 | DeRoss et al. | |
| 6,179,627 | B1 | 1/2001 | Daly et al. | |
| 6,296,514 | B1 | 10/2001 | Medina et al. | |
| 6,299,362 | B1 | 10/2001 | Gilliland et al. | |
| 6,354,872 | B1 | 3/2002 | Lilienthal, II et al. | |
| 6,370,769 | B1 | 4/2002 | Lilienthal, II | |
| 6,394,833 | B1 | 5/2002 | Bulmer et al. | |
| 2002/0132517 | A1 | 9/2002 | Tharp et al. | |
| 2003/0199191 | A1 * | 10/2003 | Ward et al. | 439/402 |
| 2004/0185703 | A1 | 9/2004 | Lee | |
| 2004/0244190 | A1 | 12/2004 | Karrasch | |

* cited by examiner

*Primary Examiner*—Tulsidas C. Patel
*Assistant Examiner*—Vladimir Imas
(74) *Attorney, Agent, or Firm*—MacMillan, Sobanski & Todd, LLC

(57) ABSTRACT

A splice block for interconnecting conductors, which include wire and insulation covering the wire. A container having openings through which conductors can access an interior of the container contains multiple connectors. Each connector includes a housing having a first slot having a width that is less than a width of an outer surface of the insulation and is engageable with the wire of a conductor, and a cover including a second slot having a width that is less than a width of an outer surface of the insulation and engageable with the wire of the conductor, the second slot being spaced along a length of the conductor from the first slot, and offset laterally from the first slot. An electrically conductive connection interconnects adjacent connectors. A container top maintains engagement among the cover, the housing and a connector, such that the first and second slots engage the wire of the conductor.

16 Claims, 7 Drawing Sheets

SPLICE BLOCK FOR INTERCONNECTING ELECTRICAL CONDUCTORS

BACKGROUND OF THE INVENTION

The present invention relates to a splice block for splicing insulation on electrical conductors, producing electric connections among the conductors, and securing the conductors to the splice container.

Insulation displacement connection (IDC) is a technique employing a connector that engages the insulation surrounding an electrical conductor in order to secure the position conductor against unwanted movement and to produce an electric connection. Conductor strain relief restrains the conductor in the IDC and holds the conductor in place to prevent its movement relative to the IDC interface and potential damage to the interface. It also improves conductor pull force performance by cutting into the insulation when the conductor is pulled vertically or longitudinally.

A splice block is a device for splicing through insulation covering various electric conductors, electrically interconnecting the conductors by engaging connectors in the block with current carrying conductors, and providing electric continuity among the conductors. Preferably the spice block also secures each conductor to the connectors and reliably maintains engagement of the conductors to the connectors despite the presence of high ambient temperature in the working environment.

Conventional conductor connectors in the prior art usually include strain relief and position definition features integrated into a mating part. These features often are in the form of bumps on a plastic connector cover, housing or another part of the connector, which bumps are used to form and IDC interface by pushing the conductor into the IDC. Such connectors rely on tolerances between the mating parts and positive mechanical locks to secure the parts mutually. Reliance on dimensional tolerances and mechanical locking permits variability in the position of the conductor relative to the IDC interface and affects the quality of the IDC interfaces.

The magnitude of the contact force varies in conventional IDCs with the diameter of the conductor and insulation. Furthermore, there is no provision in conventional IDCs for outside pressure on the conductor in two perpendicular directions, which would ensure sufficient contact force to accommodate variation in the size of the conductor. By adjusting the offset of the adjacent slots this contact force can be adjusted. A larger offset is be used for smaller conductor sizes; a smaller offset is used for larger conductor sizes. The magnitude of the contact force between the connector and conductor is preferably adjustable by changing the magnitude of the offset between adjacent slots of the connector.

It is preferred that a connector rely on mechanical engagement with the conductor insulation to provide repeatable positioning of the conductor relative to the connector and to prevent displacement of the conductor relative to the connector, especially displacement resulting from conductor pulling forces, which is an important requirement of the performance of the IDC.

Splice blocks in the prior art employ are a bus bar integrated into the connector. But this technique increases cost and requires an additional connector on the connector harness. Conventional splice blocks do not provide integration of discrete circuit protection devices (PTCs), such as resetable fuses.

SUMMARY OF THE INVENTION

A splice block, according to this invention interconnects conductors, which include wire and insulation covering the wire. A container having openings through which conductors can access an interior of the container contains multiple connectors. Each connector includes a housing having a first slot having a width that is less than a width of an outer surface of the insulation and is engageable with the wire of a conductor, and a cover including a second slot having a width that is less than a width of an outer surface of the insulation and engageable with the wire of the conductor, the second slot being spaced along a length of the conductor from the first slot, and offset laterally from the first slot. An electrically conductive connection interconnects adjacent connectors. A container top maintains engagement among the cover, the housing and a connector, such that the first and second slots continually engage the wire of the conductor.

The splice block provides a low cost solution, which can replace traditional splicing methods for a majority of splices. The splice block is completely sealed; therefore it can be used in the engine compartment where it would replace splices with dual shrink tubing. A splice block according to this invention provides integration of the discrete components, such as PTCs and diodes located close to the splice block, thereby eliminating upstream circuit protection devices and the associated wiring.

A desired number of IDC connectors is preloaded into the container with carrier strips interconnecting the connectors. The container has openings allowing desired portions of the carrier strip between certain connectors to be severed. The container also has openings to place wires and leads of circuit protection devices into the IDC connector space and to hold them in place while IDC connections are created by pushing cover of the connectors into the final position. The container also may have two covers to enclose the electronic components and the connectors. The covers may be sealed or unsealed.

A carrier strip carries sufficient current among the connectors and can be accessed in the preloaded position for cutting the strip at desired locations. The connectors may be one or two piece designs. Two piece terminals improve current carrying and mechanical performance. The lower component of each connector may be fitted over the connector cover and may be made of stainless steel for high temperature applications.

DESCRIPTION OF THE DRAWINGS

These and other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
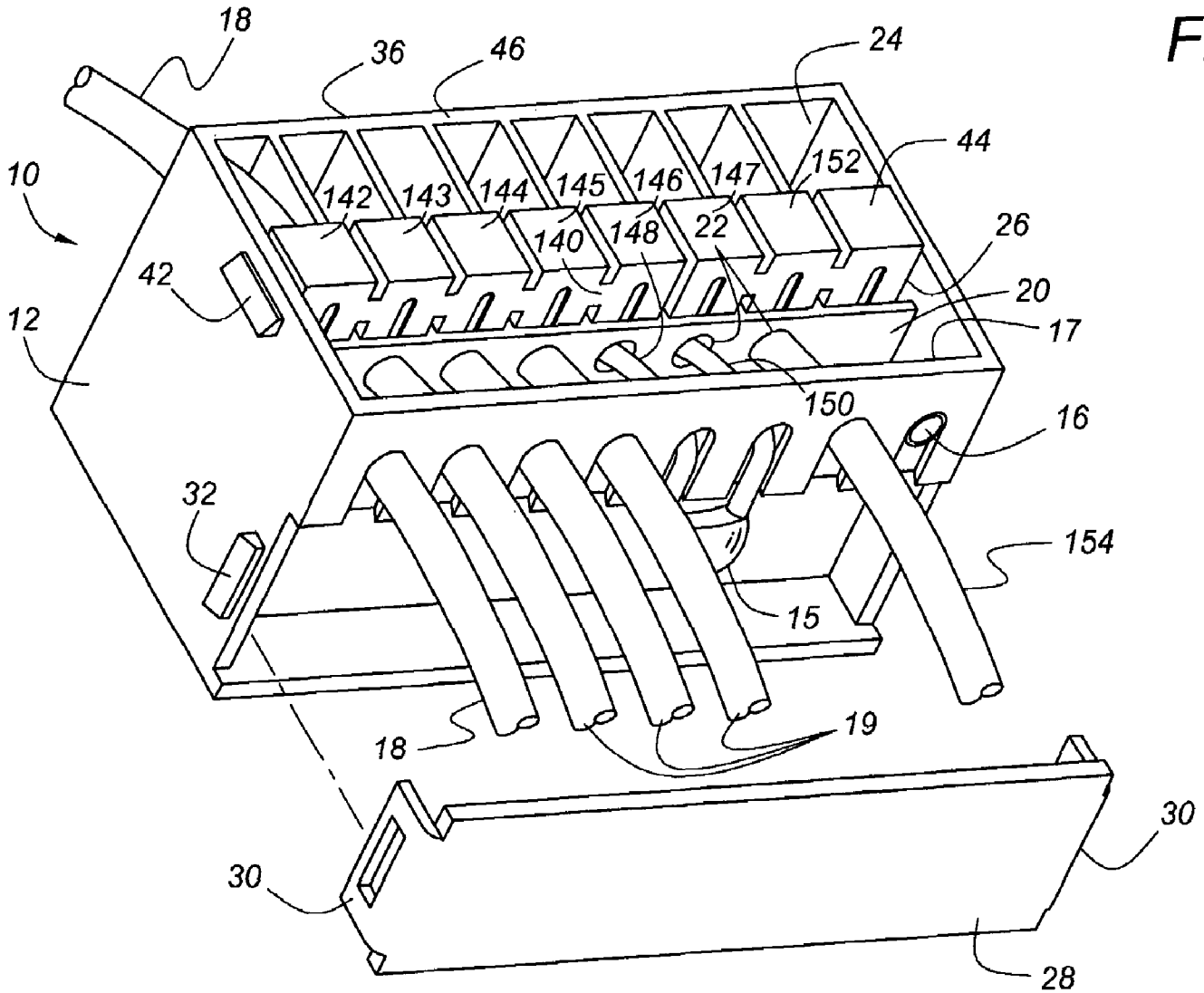
FIG. 1 is a perspective view of a splice container according to this invention showing connectors installed in the container and conductors that are interconnected by the connectors.

Referring first to FIG. 1, a splice block 10 according to this invention includes a container 12 having an enclosed space containing circuit protection devices (PTC), such as a resetable fuse 15; openings 16 in the front wall 17 of the housing, through which a power supply conductor 18 enters and leaves the housing and various conductors 19 exit the housing; a partition 20 spaced from the front wall and formed with openings 22 for the conductors to pass through; and a space 24 located adjacent the partition containing connectors 26 installed there. Preferably the container is of plastic or another electrically non-conductive material.

FIG. 1 illustrates a pathway for power supply conductor 18 to enter the container through an opening 16; to pass through the partition 20, opening 22 and connector 26; and to exit the container 12 through an opening in the back wall 36. The pathway of each conductor 19 in the container 12, however, includes a respective opening 16, the partition 20 and opening 22, and a connector 26 to which the conductor 19 is connected. Generally, conductors 19 are connected electrically to the power supply conductor 18 through the connectors 26, as describe below.

Figure 2:
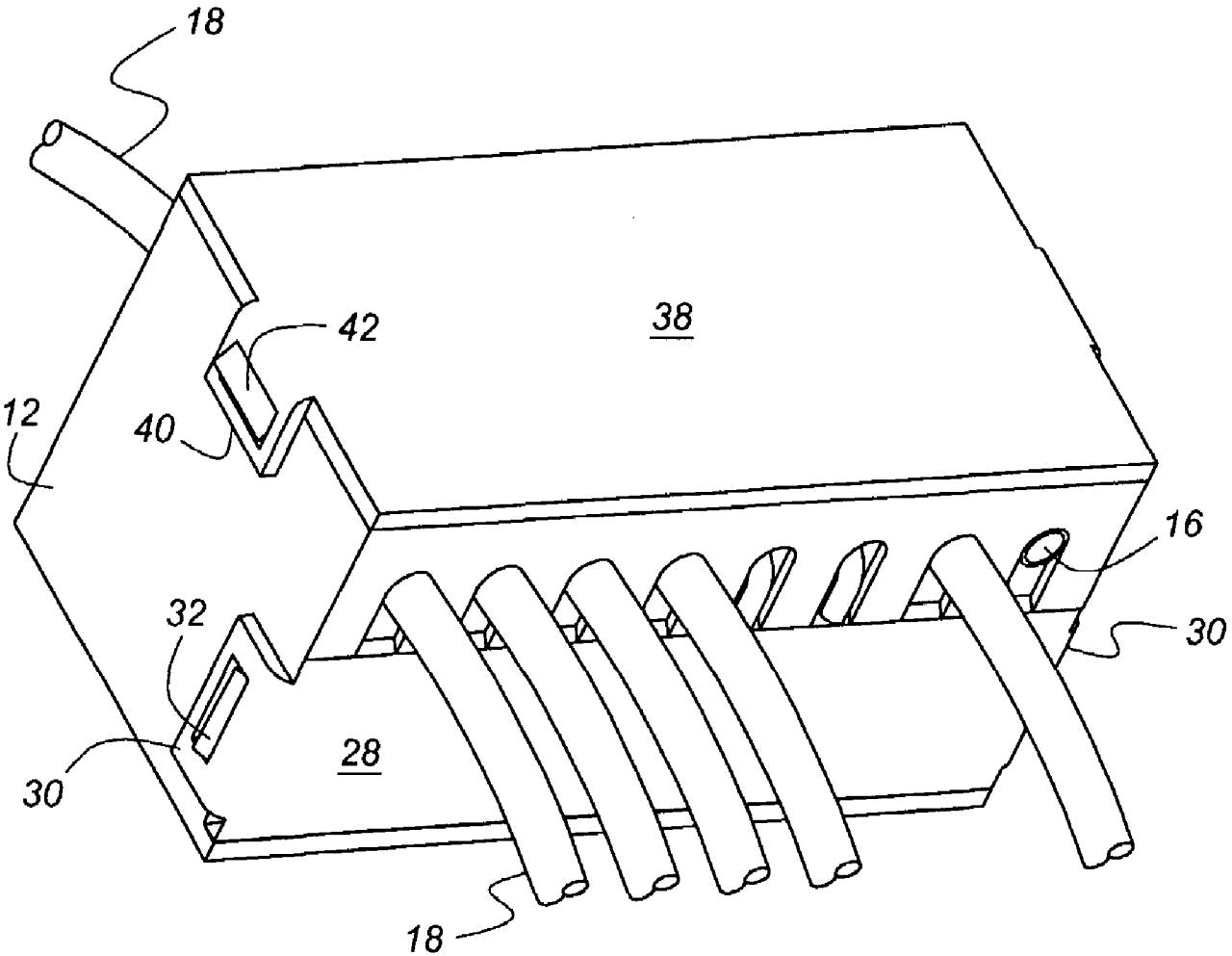
FIG. 2 is a perspective view of the splice container of FIG. 1 with the front cover and top cover installed.

FIG. 2 shows the front face of the housing and the space 14 behind it are closed by a removable cover 28 having latches 30 at each end, which respectively engage a stop 32 located at each side of the outer surface of the housing. The top of the container 12 is closed by a removable cover 38 having latches 40 at each end, which respectively engage a block 42 located at each side of the outer surface of the housing.

When conductor 18, 19 is placed in its connector 26 and before the connector is closed into engagement with its conductor, the upper surface or top 44 of the connector extends above the upper surface 46 of the housing 12. After the top cover 38 is placed in position to close the container 12, the cover is forced downward against the upper surface 44 of the connector 26 causing the connector to close and to engage the conductor and permitting the cover's latches 40 to engage the stops 42, thereby securing the cover to the housing.

Figure 3:
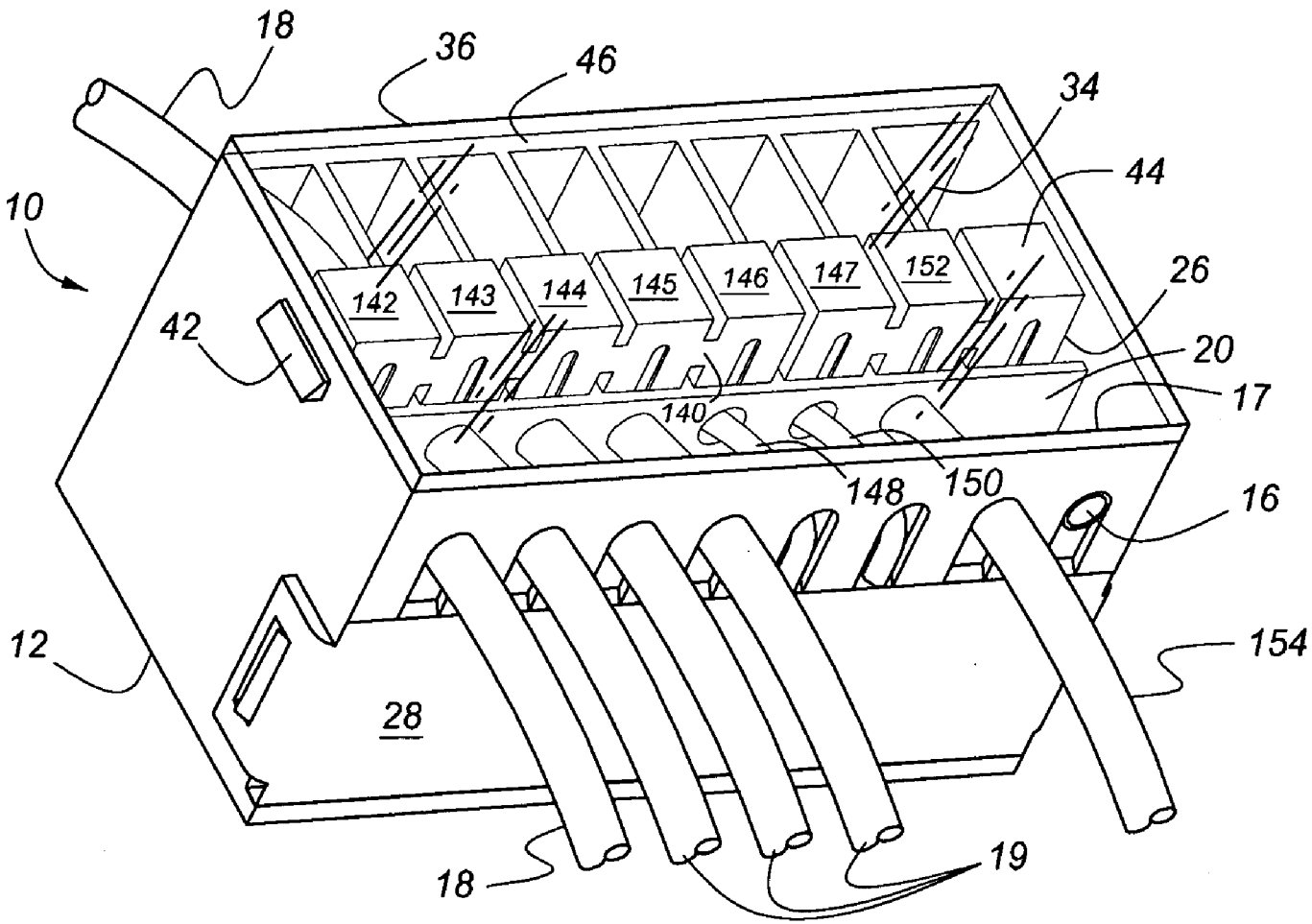
FIG. 3 is a perspective view of the splice container of FIG. 1 with the interior filled with transparent potting compound and the front cover installed.

FIG. 3 illustrates an alternative technique to closing the container 12 using a top cover 38. As an alternative to cover 38, after the conductors 18, 19 are installed in the connectors 26 located in the container 12, the interior space 24 of the container may be filled with a transparent potting compound 34, which encapsulates the connectors and conductors. The compound flows into the housing in an uncured condition, then heat and pressure are applied to the compound causing it to cure into a solid condition. The curing pressure forces the upper surface of the connectors downward causing the connectors 26 to close and to engage against the conductors 18, 19. Preferably the potting compound 34 covers the top surface 46 of the housing, thereby sealing the housing 12, connectors 26 and the portion of the conductors 18, 19 located within the container.

FIGS. 4–7 illustrate details of the An example of a connector 26 of the same type as connector 26 illustrated in FIG. 1 for securing a conductor 18 or 19 to the splice block 10 is shown in FIGS. 4–7. Connector 26 includes a hollow rectangular housing 68 having an open top, and a cover 70 that closes the top. The housing 68 includes a base and four vertical walls, two axial walls 74, 78 spaced mutually along the length of the conductor, and two lateral walls 76, 80 spaced mutually on opposite sides of the conductor 18. The conductor 18 may include a single wire or a bundle of wires 82. In neither case, the conductor 18 is enclosed by a sheath of insulation material 84, which is usually in the form of a circular cylinder, preferably of plastic or another resilient material. The housing 68 and connector 26 are formed of electrically conductive metal, preferably a copper alloy such as 5100 or beryllium copper.

Each of the axial walls 74, 78 is formed with a slot 86, 88 directed generally downward from the upper surface 89 toward the base 90, which is secured to the four walls and closes the bottom of the housing. Preferably the lateral edges of slots 86, 88 are aligned mutually. Each slot 86, 88 is formed through the thickness of the respective axial wall and includes an upper tapered transition portion 92, whose width decreases as distance along the slot 86, 88 from the upper surface 89 toward the base 90 increases. At the lower end of the transition 92, each slot 86, 88 includes a throat 94, whose width is less than the outer diameter of the insulation 84 and the width of the outer surface of the wires 82. Each slot 86, 88 terminates at a semi-circular radius.

The cover 70 includes a top 44 and two axial walls 106, 108, each wall being substantially parallel to the axial walls 74, 76 of the housing 68 and spaced mutually along the length of the conductor such that they overlap and are adjacent the outer surfaces of the axial walls.

Each of the axial walls 106, 108 is formed with a slot 110, 112 directed generally downward from the top 44 toward the base 90. Preferably the lateral edges of slots 110, 112 are aligned mutually with, but are offset laterally from the corresponding edges of the slots 86, 88 of the housing 68, as seen best in FIGS. 6 and 7. Each slot 110, 112 is formed through the thickness of the respective axial wall 76, 78 and includes an lower tapered transition portion 114, whose width decreases as distance along the slot 110, 112 from the lower edge 116 toward the top 44 increases. At the upper end of the transition 114, each slot 110, 112 includes a throat 118, whose width is less than the outer diameter of the insulation 84 and the width of the outer surface of the wires 82. Each slot 110, 112 also terminates at a semi-circular radius.

Figure 4:
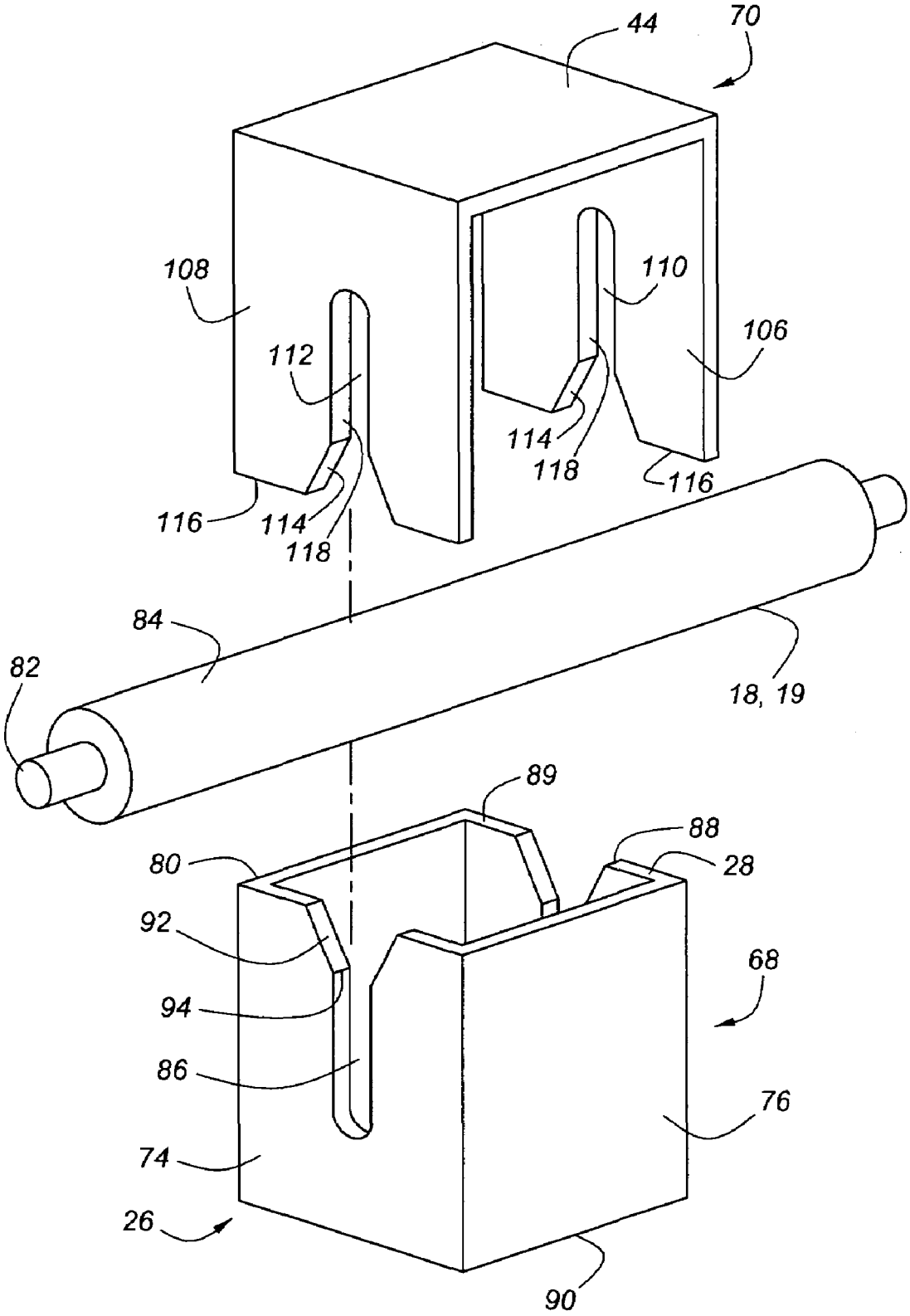
FIG. 4 is a perspective view of a conductor and a disassembled connector.

FIG. 4 shows the housing 68 disposed to receive a conductor 18 on the transition surface 92 of the slots 86, 88, and the cover 70 located to contact the conductor 18 at the transition surface 114 of the slots 110, 112. Installation of the conductor 18 in the connector 26 begins by placing the conductor on the transition surfaces 92 of the slots 86, 88 of the housing 68, engaging the conductor with the transition surfaces 114 of the slots 110, 112 of the cover 70, and then forcing the cover downward such that the conductor passes into the throats 94 of the housing and the throats 118 of the cover. Throats 94 cut into the insulation 84 at opposite lateral sides as the conductor 18 moves downward along slots 86, 88. Throats 118 cut into the insulation at opposite lateral sides as the cover 70 and its slots 110, 112 move downward across the conductor. As the conductor 18 enters and passes through the throats 94, 118, the insulation 84 is compressed and cut locally through its thickness at each throat by its interference with edges of the throats, and the wire 82 contacts the lateral surfaces of the slots 86, 88, 110, 112, hereby bringing the wire into direct contact with the sides of the slots. After the conductor 18 passes through the throats 94, 118 and the cuts are made through the thickness of the insulation 84, the length of the insulation 84 and wires 82 that is spaced along the conductor from slots 86, 88, 110, 112 expands radially outward from the compressed condition to the generally circular cylindrical shape seen best in FIGS. 4 and 5.

Figure 7:
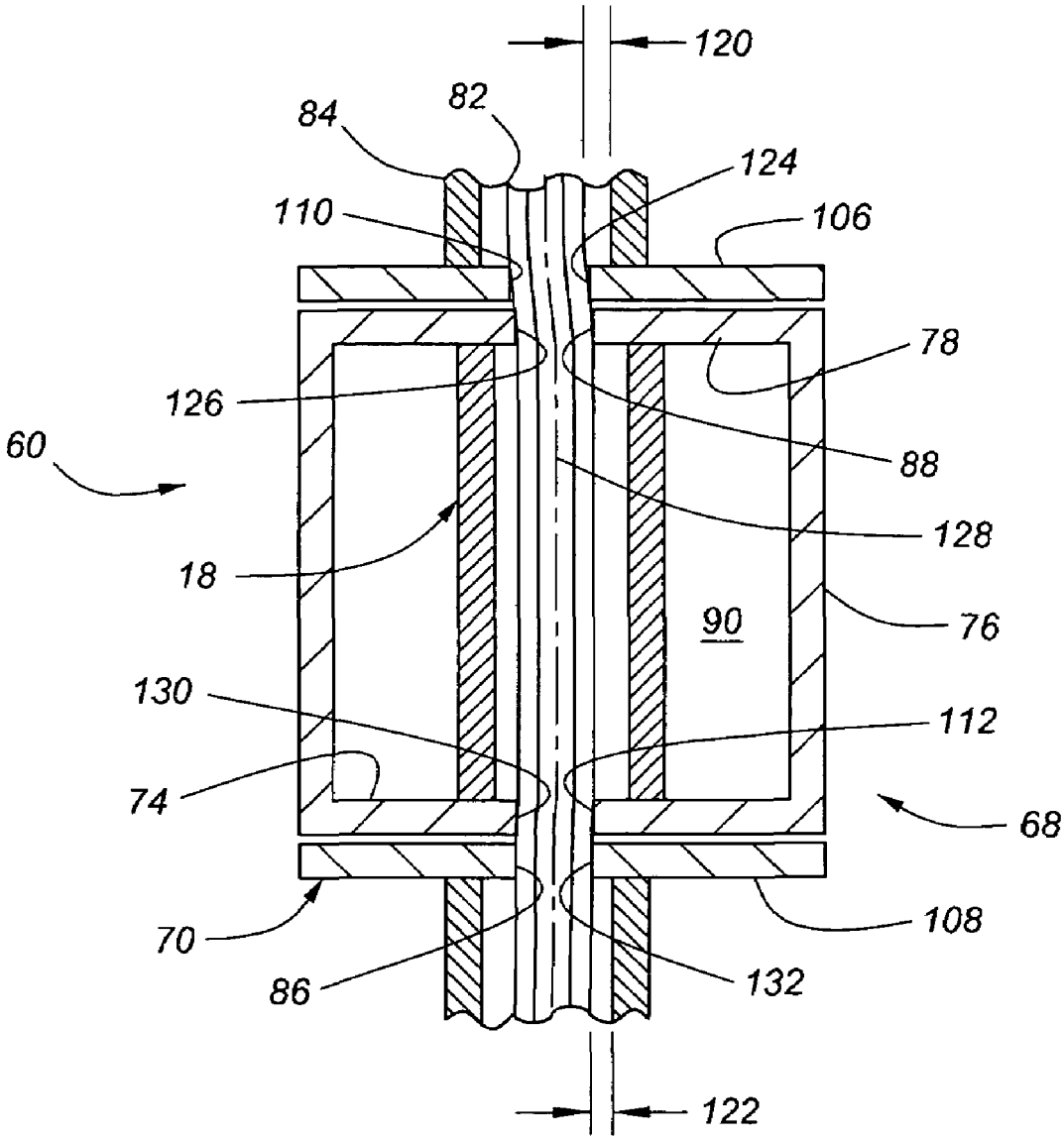
FIG. 7 is a cross section taken at plane 7—7 of FIG. 6.

FIG. 7 shows the lateral offset 120 between adjacent slots 88 and 110, and the lateral offset 122 between adjacent slots 86, 112. Because of the presence of lateral offset 120, surface 164 of slot 110 contacts the wire 82 with a force that is directed leftward, and surface 126 of slot 88 contacts the wire with a force that is directed rightward. The points of contact 124, 126 and the contact forces are spaced axially producing a counterclockwise moment, which tends to rotate the conductor 18 counterclockwise with respect to the axis 128 of the conductor within the housing 68. Similarly, because of the presence of lateral offset 122, surface 130 of slot 112 contacts the wire 82 with a force that is directed leftward, and surface 132 of slot 86 contacts the wire with a force that is directed rightward. The points of contact 130, 132 and the contact forces are spaced axially producing a clockwise moment, which tends to rotate the conductor 18 clockwise with respect to the axis 128 of the conductor within the housing 68.

Figure 6:
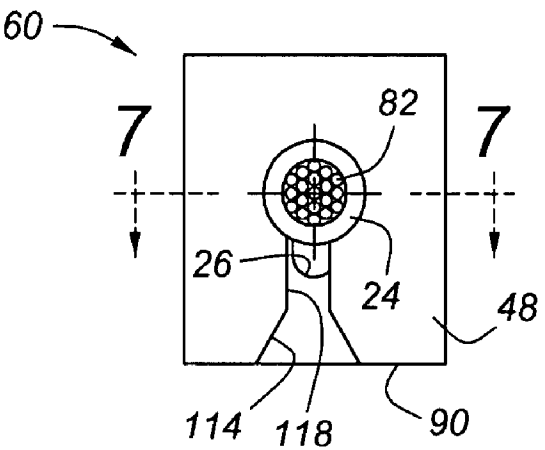
FIG. 6 is an end view of the connector and conductor of FIG. 5.
Figure 5:
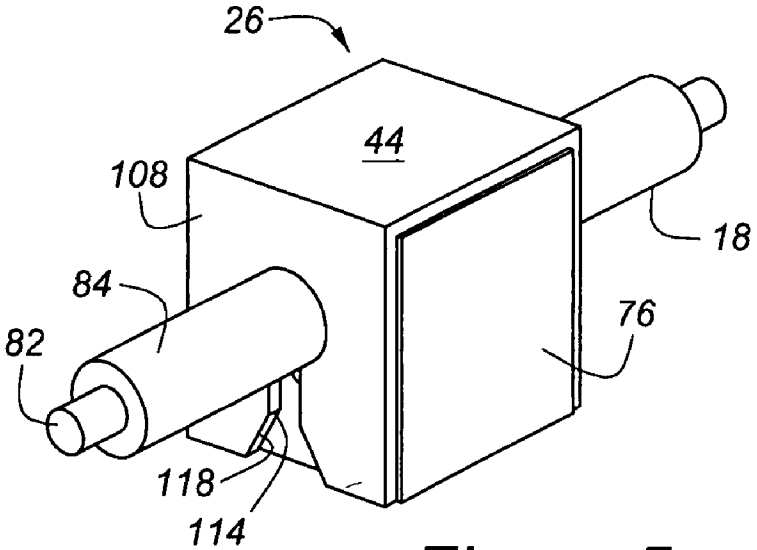
FIG. 5 is a perspective view of a conductor secured to a connector.

The correctly installed position of the conductor 18 is reached when the lower edges of the cover 70 are aligned with the base 90 of the housing 68, as shown in FIG. 6.

Figure 8:
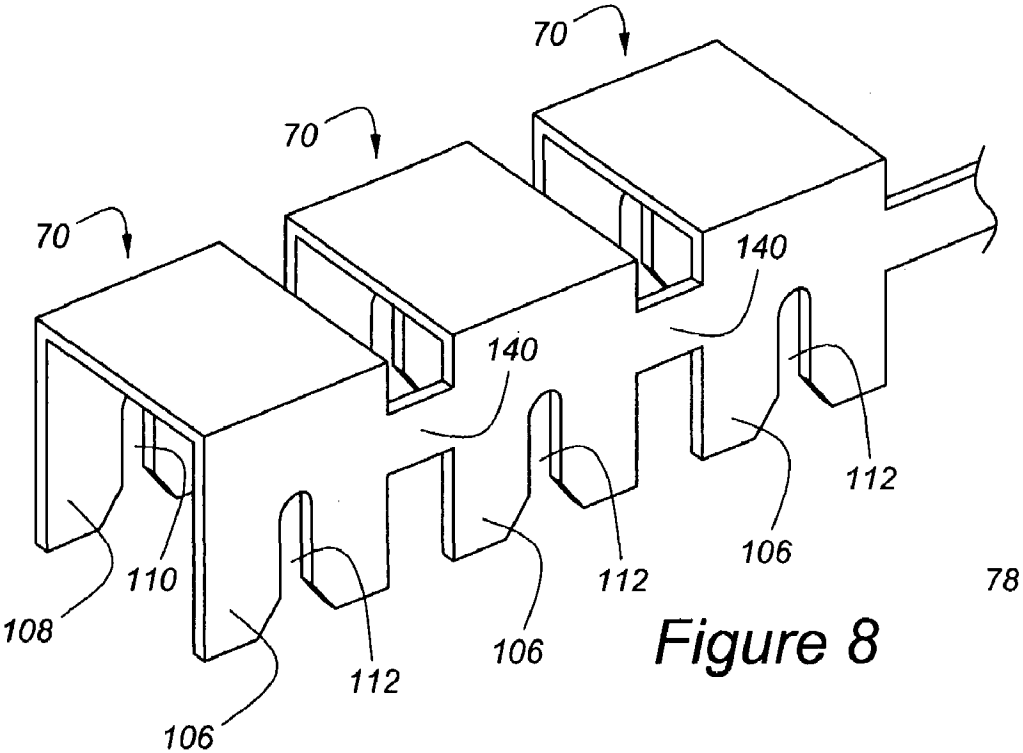
FIG. 8 is a perspective view of a series of interconnected covers.

FIG. 8 illustrates that the cover 70 of each connector 26 is produced in a series of stampings with each cover being connected to an adjacent cover by a tab 140 interconnecting axial walls 106. Depending on the requirements of the application, certain connectors 26 in the splice block 10 may be electrical disconnected from other connectors thereby severing the tabs 140 located at the desired discontinuity, but other tabs remain in place, thereby completing an electric connection between the covers adjacent the unsevered tabs in the splice block 10. For example in FIG. 1, electric current may be supplied through conductor 18 from a power source at a forward location in a motor vehicle to a splice block 10 located near a rear taillights. Conductors 19, which distribute the incoming current to the taillights, are electrically connected to conductor 18 through the electrical connections produced at the IDC connectors 142–145 and the continuity provided by the tabs 140 that interconnect connectors 142–145. The conductors or leads 148, 150 from resetable fuse 15 engage connectors 146, 147; a tab 140 interconnects adjacent connectors 145, 146; a tab 140 interconnects adjacent connectors 147, 152; and conductor 154 engages connector 152; but a tab between connectors 146 and 147 is severed and inoperable. Therefore, fuse 15 controls against excessive current by opening and closing a circuit connection between connectors 145 and 152 upon opening and closing a connection across its leads 148, 150 and connectors 146, 147.

In this way only one connector 18 is required to carry current to the rear taillights from the power supply. The current is distributed at the splice block 10, and the circuit is protected against excessive current locally at the splice block rather than at a forward vehicle location.

Figure 9:
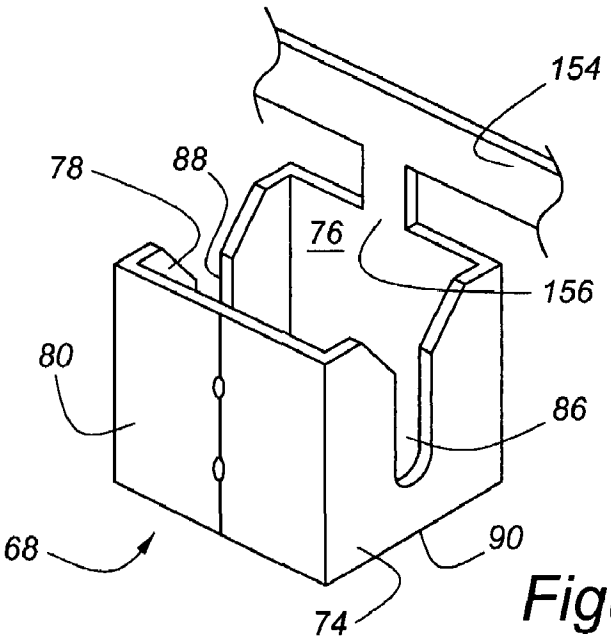
FIG. 9 is a perspective view showing a strip connected to one of a series of housings connected to the strip.

FIG. 9 illustrates that the housing 68 of each connector 26 is produced in a series of stampings, with each housing being connected to an adjacent housing by a strip of metal 154, which that interconnects the other housings of the series. The metal strip 154 is disconnected from each housing by snipping through its thickness at plane 156, preferably before installing each housing in the splice block 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A splice block for interconnecting conductors that each include wire and insulation covering the wire, comprising:

a container having openings through which conductors can access an interior of the container;

multiple connectors located in the container, each connector including a housing having a first slot including first and second laterally-spaced surfaces having therebetween a first width that is less than a width of an outer surface of the insulation and engageable with the wire of a conductor;

a cover including a second slot adjacent the first slot, including third and fourth laterally-spaced surfaces having therebetween a second width that is less than a width of an outer surface of the insulation and engageable with the wire of the conductor, the second slot being spaced along a length of the conductor from the first slot, and offset laterally from the first slot;

an electrically conductive connection to an adjacent connector; and forcing means for maintaining engagement among the cover, the housing and the connector such that the first and second slots engage the wire of the conductor, said forcing means comprising one of a container cover secured to the container and contacting the cover of each connector with an interference fit, and potting compound secured to the container and contacting the cover of each connector with an interference fit.

2. The splice block of claim 1 wherein the first slot further includes a first transition portion communicating with the first width, having a width that decreases as distance along a the length of the first slot toward the first width increases.

3. The splice block of claim 1 wherein:

the first slot further includes a first transition portion communicating with the first width, having a width that decreases as distance along a length of the first slot toward the first width increases; and the second slot further includes a second transition portion communicating with the second width, having a width that decreases as distance along a length of the second slot toward the second width increases.

4. The splice block of claim 1, wherein:

the housing further comprises a third slot spaced along a length of the conductor from the first and second slots, including fifth and six laterally spaced surfaces having therebetween a third width that is less than a width of an outer surface of the insulation and engageable with the wire of the conductor; and the cover having a fourth slot adjacent the third slot and offset laterally from the first and second slots, including seventh and eighth laterally spaced surfaces having therebetween a fourth width that is less than a width of an outer surface of the insulation and engageable with the wire of the conductor.

5. The splice block of claim 4 wherein:

the first slot further includes a first transition portion communicating with the first width, having a width that decreases as distance along a length of the first slot toward the first width increases:

the second slot further includes a second transition portion communicating with the second width, having a width that decreases as distance along a length of the second slot toward the second width increases;

the third slot further includes a third first transition portion communicating with the third width, having a width that decreases as distance along a length of the third slot toward the third width increases; and the fourth slot further includes a fourth transition portion communicating with the fourth width, having a width that decreases as distance along a length of the fourth slot toward the four width increases.

6. The splice block of claim 4 wherein:

the first and second surfaces are mutually aligned in a first lateral plane;

the third and fourth surfaces are mutually aligned in a second lateral plane;

the fifth and sixth surfaces are mutually aligned in a third lateral plane; and the seventh and eight surfaces are mutually aligned in a fourth lateral plane.

7. The splice block of claim 1 further comprising:

a power supply connector located in the container and engagable with a power supply conductor;

a first connector located in the container and mutually electrically interconnected with the power supply connector;

a second connector located in the container electrically disconnected from the first connector;

a fuse located in the container, including a first lead engaged with the first connector and a second lead engaged with the second connector;

a third connector located in the container, electrically interconnected with the second connector, and engagable with a second conductor.

8. The splice block of claim 1 further comprising:

a power supply connector located in the container and engagable with a power supply conductor;

a first connector located in the container, mutually electrically interconnected with the power supply connector, and engageable with a second conductor.

9. A splice block for interconnecting conductors that each include wire and insulation covering the wire, comprising:

a container having openings through which conductors can access an interior of the container;

multiple connectors located in the container, each connector including a housing including a base, a first wall extending from the base and a first slot including first and second laterally-spaced surfaces having therebetween a first width that is less than a width of an outer surface of the insulation and engagable with the wire of a conductor;

a cover including a second slot adjacent the first slot, including third and fourth laterally-spaced surfaces having therebetween a second width that is less than a width of an outer surface of the insulation and engageable with the wire of the conductor, the second slot being spaced along a length of the conductor from the first slot, and offset laterally from the first slot; and an electrically conductive connection to an adjacent connector; and a removeable container top, securable to the container and contacting the cover of at least one connector with an interference fit after a conductor is disposed between the housing and the cover of said at least one connector;

a power supply connector located in the container and engagable with a power supply conductor; and a first connector located in the container, mutually electrically interconnected with the power supply connector, and engageable with a second conductor.

10. The splice block of claim 9 wherein the first slot further includes a first transition portion communicating with the first width, having a width that decreases as distance along a length of the first slot toward the first width increases.

11. The splice block of claim 9 wherein:

the first slot further includes a first transition portion communicating with the first width, having a width that decreases as distance along a length of the first slot toward the first width increases; and the second slot further includes a second transition portion communicating with the second width, having a width that decreases as distance along a length of the second slot toward the second width increases.

12. The splice block of claim 9 further comprising:

a forcing means that includes one of a container cover secured to the container and contacting the cover of each connector with an interference fit, and potting compound secured to the container and contacting the cover of each connector with an interference fit.

13. The splice block of claim 9, wherein:

the housing further comprises a second wall extending from the base, having a third slot spaced along a length of the conductor from the first and second slots, including fifth and sixth laterally spaced surfaces having therebetween a third width that is less than a width of an outer surface of the insulation and engageable with the wire of the conductor; and the cover having a fourth slot adjacent the third slot and offset laterally from the first and second slots, including seventh and eighth laterally spaced surfaces having therebetween a fourth width that is less than a width of an outer surface of the insulation and engageable with the wire of the conductor.

14. The splice block of claim 13 wherein:

the first slot further includes a first transition portion communicating with the first width, having a width that decreases as distance along a length of the first slot toward the first width increases;

the second slot further includes a second transition portion communicating with the second width, having a width at decreases as distance along a length of the second slot toward the second width increases;

the third slot further includes a third transition portion communicating with the third width, having a width that decreases as distance along a length of the third slot toward the third width increases; and the fourth slot further includes a fourth transition portion communicating with the fourth width, having a width that decreases as distance along a length of the fourth slot toward the fourth width increases.

15. The splice block of claim 13 wherein:

the first and second surfaces are mutually aligned in a first lateral plane;

the third and fourth surfaces are mutually aligned in a second lateral plane;

the fifth and sixth surfaces are mutually aligned in a third lateral plane; and the seventh and eight surfaces are mutually aligned in a fourth lateral plane.

16. The splice block of claim 9 further comprising:

a power supply connector located in the container and engagable with a power supply conductor;

a first connector located in the container and mutually electrically interconnected with the power supply connector;

a second connector located in the container electrically disconnected from the first connector;

a fuse located in the container, including a first lead engaged with the first connector and a second lead engaged with the second connector;

a third connector located in the container, electrically interconnected with the second connector, and engagable with a second conductor.

* * * * *